US005156129A

United States Patent [19]

Sumida et al.

[11] Patent Number: 5,156,129

[45] Date of Patent: Oct. 20, 1992

[54] FUEL SUPPLY DEVICE FOR AN INTERNAL COMBUSTION ENGINE

[75] Inventors: Mamoru Sumida; Osamu Matsumoto; Kazuyoshi Yamamoto, all of Himeji, Japan

[73] Assignee: Mitsubishi Denki K.K., Tokyo, Japan

[21] Appl. No.: 774,882

[22] Filed: Oct. 11, 1991

[30] Foreign Application Priority Data

Nov. 13, 1990 [JP] Japan ..... 2-119160[U]

[51] Int. Cl.[5] ..... F02M 55/02

[52] U.S. Cl. ..... 123/470; 123/456; 251/367

[58] Field of Search ..... 123/456, 468, 469, 470; 239/585, 600; 251/367; 137/883

[56] References Cited

U.S. PATENT DOCUMENTS

| | | | |
|---|---|---|---|
| 3,857,573 | 12/1974 | Pugh . | |
| 4,046,478 | 9/1977 | Messerschmidt . | |
| 4,240,384 | 12/1980 | Urbinati et al. | 123/470 |
| 4,294,215 | 10/1981 | Hans et al. | 123/469 |
| 4,295,452 | 10/1981 | Lembke et al. | 123/470 |
| 4,327,690 | 5/1982 | Sauer et al. | 123/469 |
| 4,492,201 | 1/1985 | Radaelli | 123/470 |
| 4,693,223 | 9/1987 | Eshleman | 123/468 |
| 4,727,843 | 3/1988 | Petersen et al. | 123/470 |
| 4,751,905 | 6/1988 | Bonfiglioli et al. | 123/470 |
| 4,860,710 | 8/1989 | Hafner et al. | 123/470 |
| 5,012,787 | 5/1991 | Hafner et al. | 123/470 |
| 5,044,338 | 9/1991 | Shelton | 123/469 |
| 5,046,469 | 9/1991 | Gmelin | 123/470 |

FOREIGN PATENT DOCUMENTS

| | | |
|---|---|---|
| 2338206 | 2/1974 | Fed. Rep. of Germany . |
| 2920969 | 1/1980 | Fed. Rep. of Germany . |
| 0003061 | 1/1990 | Japan . |
| 0016062 | 5/1990 | Japan . |
| 0016064 | 5/1990 | Japan . |

*Primary Examiner*—E. Rollins Cross
*Assistant Examiner*—Thomas N. Moulis
*Attorney, Agent, or Firm*—Sughrue, Mion, Zinn, Macpeak & Seas

[57] ABSTRACT

A fuel supply device for an internal combustion engine which is composed of: an injector by which fuel is supplied from a direction other than a direction to a drive axis: a fuel body which accommodates the injector and which makes a fuel supply passage; a cap which presses and fixes the injector to the fuel body; and an elastic body which is interposed between the injector and the cap; wherein the injector has multi-hole type injection holes, and the elastic body positions the injector in relation to the cap.

2 Claims, 3 Drawing Sheets

FUEL SUPPLY DEVICE FOR AN INTERNAL COMBUSTION ENGINE

BACKGROUND OF THE INVENTION

1. Field of the Invention

This invention relates to a fuel supply device for an internal combustion engine which supplies fuel to both an intake manifold of an internal combustion engine, particularly a side feeding type or a bottom feeding type injector, and also a fuel delivery pipe in which the injector is integrated.

2. Discussion of the Background

In a top feeding type injector, as described in, for example, Japanese Examined Utility Model Publication Nos. 23580/1988, 39904/1989, or 16064/1990, fuel vapor is produced by heat generated by the injector. As a result, fuel pressure is lowered, and a predetermined quantity of fuel is vaporized and therefore cannot be injected. To improve this problem, for instance, as described in Japanese Unexamined Patent Publication No. 35077/1989, a side feeding type or a bottom feeding type injector has been developed and reduced to practice.

Irrespective of the injectors of these types, reducing operational sound of the injector, for the purpose of promoting a noise-free vehicle, becomes a problem of in this field of technology that is commonly addressed. In the side feeding type injector, as shown in FIG. 4, the radiation or the propagation of the operational sound is prevented by interposing the elastic body 3 of a gummy material or the like between the injector 1 and the cap 4 that fixes the injector 1 to a fuel body.

Furthermore, in recent times, complying with pluralization of intake valves for an internal combustion engine, a multi-injection hole type injector which can inject fuel towards respective intake valves for a single cylinder, has been reduced to practice. Irrespective of the number of the intake valves, the multi-injection hole type injector is adopted for the purpose of a measure for deposit (blocking by dirt) of the injector. When the multi-injection hole type injector is utilized, it is necessary to position the direction of the injection holes with respect to the intake valve of the engine, that is, with respect to the intake manifold. This necessity is common to any cases of the top feeding type, the side feeding type, and the bottom feeding type injectors.

However, as for the positioning or centering of the rotational direction of the injector at the axis of the injector, a method is adopted in which the injector is inserted to a fuel body having a plane portion as a guide. However, the plane portion becomes a transmission path of the operational sound of the injector. As a result, a noise free vehicle cannot be achieved.

SUMMARY OF THE INVENTION

It is an object of the present invention to provide a fuel supply device for an internal combustion engine capable of decreasing the operational sound of an injector, and easily positioning the rotational direction of the injector.

According to an aspect of the present invention, there is provided a fuel supply device for an internal combustion engine which comprises: an injector by which fuel is supplied from a direction other than a direction to a drive axis; a fuel body which accommodates the injector and which makes a fuel supply passage; a cap which presses and fixes the injector to the fuel body; and an elastic body which is interposed between the injector and the cap; wherein the injector has multi-hole type injection holes, and the elastic body has a means of positioning the injector in relation to the cap.

Figure 1A:
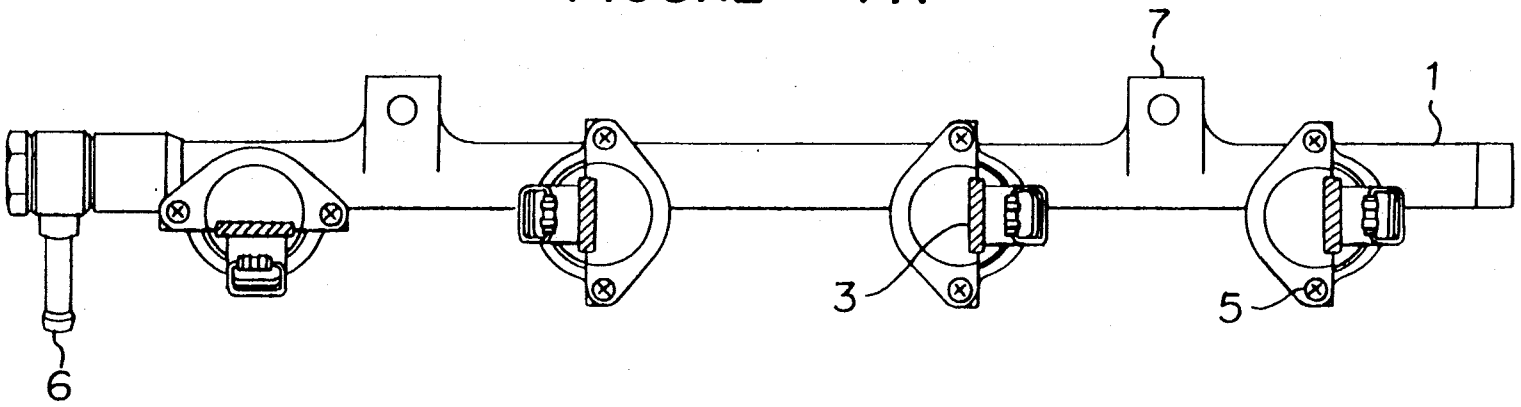
FIGS. 1A and 1B are respectively a plan and a front view of an embodiment of a total fuel supply device for an internal combustion engine according to the present invention.

In the drawings, a reference numeral 1 designates a fuel body, 1*a*, an injector case, 2, an injector, 3, an elastic body, 3*a*, a projected portion, 4, a cap, 5, a fixing screw, 6, a fuel inlet port, 7, a fixing flange, 8, a fuel passage, 9, O-ring, and 10, a fuel return port.

In the drawings, the same notation designates the same or the corresponding part.

DETAILED DESCRIPTION OF THE PREFERRED EMBODIMENTS

Figure 1B:
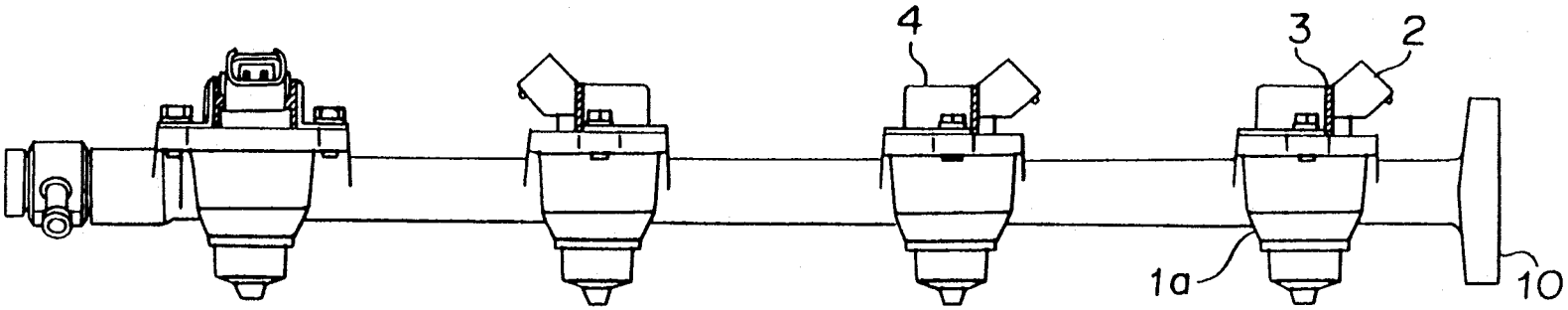
Figure 2A:
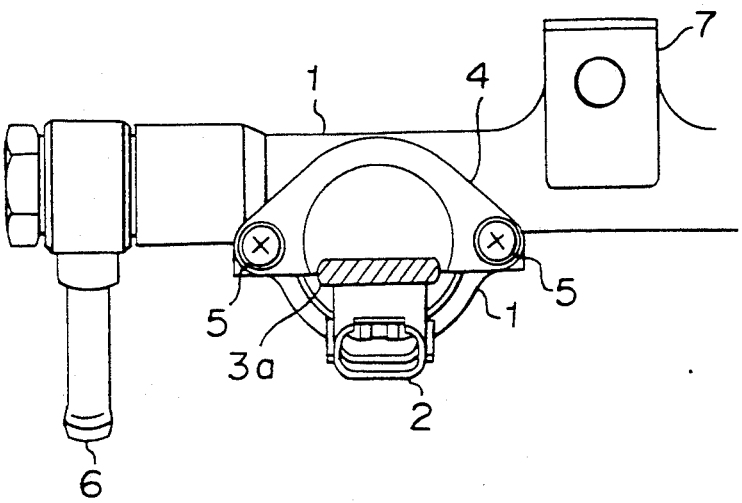
FIGS. 2A and 2B are respectively a plan and a front view of an enlarged portion of the fuel supply device.
Figure 2B:
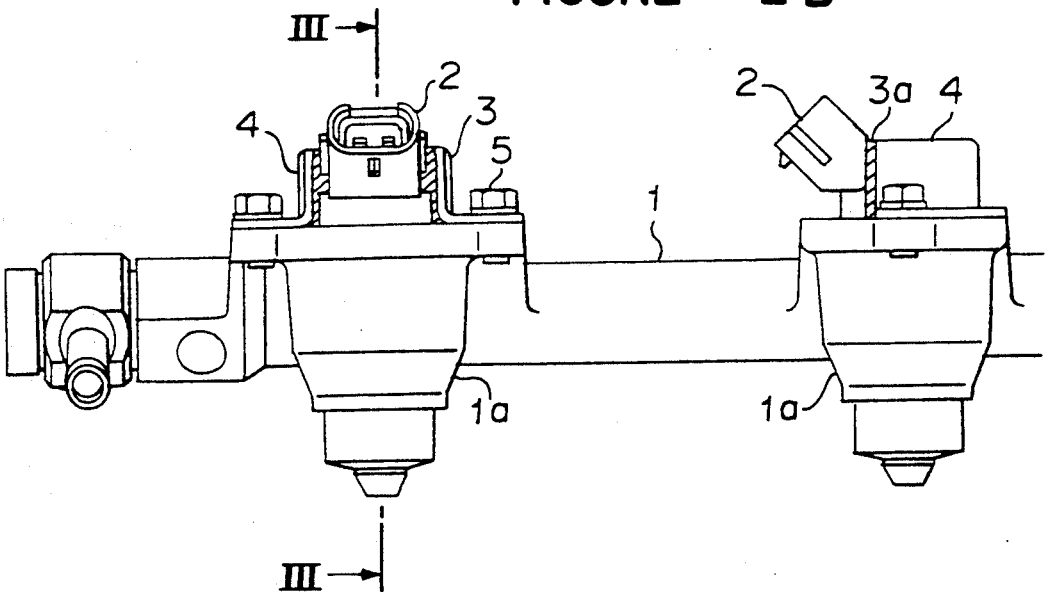
Figure 3:
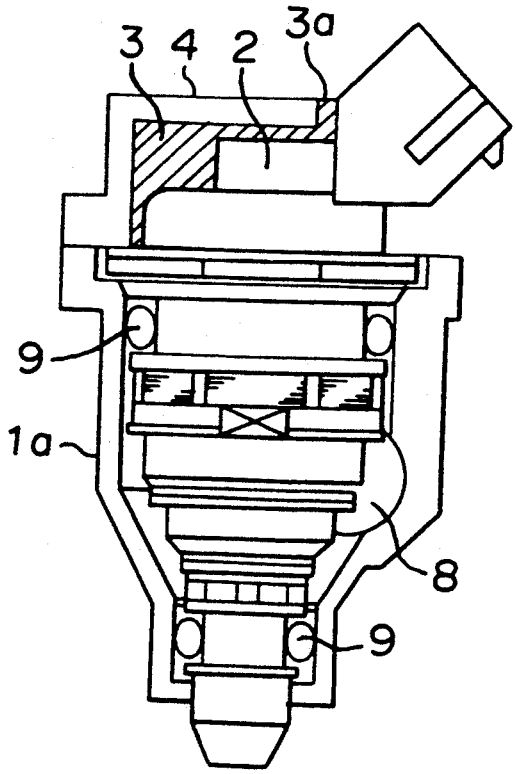
FIG. 3 is an enlarged sectional view of FIG. 2B taken along line III—III.
Figure 4:
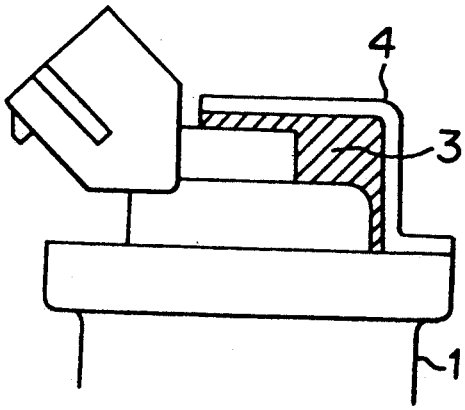
FIGURE 4 Prior Art
FIG. 4 is a sectional view of a conventional fuel supply device.

In the following description an embodiment of this invention will be explained referring to the drawings. FIGS. 1A and 1B are respectively a plan and a front view of a total fuel supply device for an internal combustion engine according to the invention. FIGS. 2A and 2B are respectively a plan and a front view showing an enlarged fuel supply device. FIG. 3 is an enlarged sectional view of FIG. 2B taken along line III—III. In the drawings, the fuel passage 8 (FIG. 3) passes through the fuel body 1 in the longitudinal direction. The injector cases la are provided at four places in the midst of the fuel body 1. The injector case 1*a* and the fuel passage 8 are hydraulically connected.

In FIG. 3, the injector 2 is accommodated in the injector case 1*a*, which is sealed from the outside portion by the O-ring 9 for sealing the fuel passage. Furthermore, the injector 2 and the cap 4 are set by a body for decreasing the operational sound, for instance, by the elastic body 3. Furthermore, the positioning of the injector 2 is carried out by putting the projected portion 3*a*, which is provided in the elastic body 3, between the injector 2 and the cap 4.

Fuel is supplied from the fuel inlet port 6. The fuel pressure is controlled by a fuel pressure control valve, not shown, which is fixed at the fuel return port 10. The excess quantity of fuel is returned to a fuel tank.

Furthermore, the fuel body 1 can be positioned with respect to the intake valve, not shown, of the engine, by the fixing flange 7 for the intake manifold. Furthermore, the cap 4 is positioned with respect to the fuel body 1 by the fixing screw 5. Accordingly, the injector 2 can be positioned with respect to the intake valve, by providing the projected portion 3*a* in the elastic body 3, which positions the injector 2 and the cap 4.

In the fuel supply device for an internal combustion engine constructed as above, the projected portion 3*a* provided in the elastic body is put between the injector 2 and the cap 4. Therefore the rotational direction of the injector 2 can be positioned with respect to the intake valve of the engine. Furthermore, the operational sound of the injector can be absorbed and decreased by the elastic body, as before.

As mentioned above, according to the invention, since a positioning means of the injector and the cap is provided at the elastic body, the rotational direction of the injector can be positioned with respect to the intake valve without increasing the number of parts. By this means, the attachability of a multi-injection hole type injector, especially, a side feeding type injector or a bottom feeding type injector to the fuel delivery pipe, is promoted, which exhibits a maximum injection capability.

What is claimed is:

1. A fuel supply device for an internal combustion engine, said device comprising:

an injector;

a fuel body which accommodates the injector and which forms a fuel supply passage;

a cap, having a top face, which presses and fixes the injector to the fuel body; and an elastic body having an extended portion which is interposed between the injector and the top face of the cap so that the cap is isolated from contact with the injector;

wherein the injector and the elastic body form a means for rotationally positioning the injector in relation to the cap and the fuel body, and for reducing operational noise communicated through the injector.

2. The fuel supply device of claim 1, wherein the injector has multi-hole-type injection holes, and the cap has at least one fixing screw so that the injector may be positioned with respect to the fuel body and an intake valve of an engine by rotating the cap and elastic body.

* * * * *